United States Patent [19]

Wilson

[11] Patent Number: 4,519,503

[45] Date of Patent: May 28, 1985

[54] NESTABLE/STACKABLE BASKET/TRAY COMBINATION FOR USE IN BAKERY GOODS DISTRIBUTION SYSTEMS

[76] Inventor: James D. Wilson, 421 Vista Suerte, Newport Beach, Calif. 92660

[21] Appl. No.: 523,179

[22] Filed: Aug. 15, 1983

[51] Int. Cl.[3] ..... B65D 21/04

[52] U.S. Cl. ..... 206/505; 211/126

[58] Field of Search ..... 206/505, 506, 507; 211/126, 128

[56] References Cited

U.S. PATENT DOCUMENTS

| | | | |
|---|---|---|---|
| 3,404,804 | 10/1968 | Frater | 206/505 |
| 4,007,839 | 2/1977 | Stahl | 206/505 |
| 4,211,327 | 7/1980 | Stahl et al. | 206/505 |
| 4,334,616 | 6/1962 | Wilson | 206/505 |
| 4,383,611 | 5/1983 | Kreeger | 206/505 |

*Primary Examiner*—George E. Lowrance

*Attorney, Agent, or Firm*—Keith D. Beecher

[57] ABSTRACT

A nestable/stackable basket/tray combination container for transporting, storing and displaying bakery goods, and other products, which may be stacked on top of like basket/tray combination containers at different stacking levels for accommodating products of different heights, and which may be nested down into one another when empty. The trays are slidable out of the open front of the baskets for examination and/or replenishment of the products, or so that the trays alone may be loaded on route trucks equipped with rails for supporting the trays.

5 Claims, 8 Drawing Figures

NESTABLE/STACKABLE BASKET/TRAY COMBINATION FOR USE IN BAKERY GOODS DISTRIBUTION SYSTEMS

BACKGROUND OF THE INVENTION

Bakery products are delivered to many retail outlets in trays which are loaded onto rails of appropriate route delivery trucks. The trays are loaded onto the route trucks by sliding them onto the rails, either at the bakery itself or at depots. In accordance with the prior art practice, the trays are shipped from the bakery to the depots in large racks which are loaded onto large transport trucks. The trays are supported on rails in the individual racks, and slide along the rails as they are loaded.

For example, bread baked in Los Angeles may be trucked to depots in adjacent communities in large transport trucks. The bread is loaded onto trays which, in turn, are stacked on rails in large racks, the racks being loaded onto the transport trucks. The racks are unloaded at the depots, and they are placed so that the individual route delivery truck drivers can slide the loaded trays out of the racks, and then slide them onto rails in their route tracks for delivery to the local retail outlets. The empty racks, and trays which were used on the previous day, are loaded back on the transport trucks for return to the bakery.

However, the racks referred to in the preceding paragraph weight about 500 pounds, and they are awkward, bulky, hazardous, costly and space-consuming. An important objective of the present invention is to provide a stackable-nestable basket/tray combination container which may be used in a distribution system which retains all the advantages of the prior art distribution system, and yet which eliminates the heavy and costly racks.

Another type of bakery goods distribution system, which does not require the large, heavy racks discussed in the preceding paragraphs, uses nestable/stackable baskets such as described in U.S. Pat. Nos. 4,308,954 and 4,334,616 which issued in the name of the present inventor. The nestable/stackable baskets described in the patents may be loaded with bakery goods at the bakery and stacked on top of one another on appropriate dollies. The stacks of loaded baskets may then be transported to the depots and/or to the retail outlets on appropriate trucks. Upon arrival at the retail markets, the stacks of loaded baskets may be rolled on the dollies to appropriate positions on the floor of the market. The products in the baskets may then be displayed at the various positions and made available for purchase while still in the baskets. When the baskets are empty, they may be nested down into one another for space conservation purposes, and returned to the bakery.

However, the prior art bakery goods distribution system using stackable/nestable baskets lacks the flexibility of the prior art tray distribution system described above. This is because the individual baskets cannot be easily removed from the stack for examination of the products loaded thereon, or in circumstances, for example, when selected baskets only are to be delivered to a particular market. Moreover, the basket distribution system is not adaptable to present-day route trucks which are equipped with rails.

Another objective of the present invention is to provide a nestable/stackable basket/tray container combination which enables the bakery products to be distributed in a system which has all the advantages of both the prior art tray and basket distribution systems with none of the disadvantages.

The nestable/stackable basket/tray container combination of the present invention, in the embodiment to be described, comprises a nestable/stackable basket that has a variety of stacking heights to accommodate different height bakery products. The basket has an open bottom and an open front end. The combination also includes a tray which is supported on the lower edges of the sides of the basket, which are bent in for that purpose, and the tray is adapted to be pulled out through the open front of the basket.

DETAILED DESCRIPTION OF THE ILLUSTRATED EMBODIMENT

Figure 1:
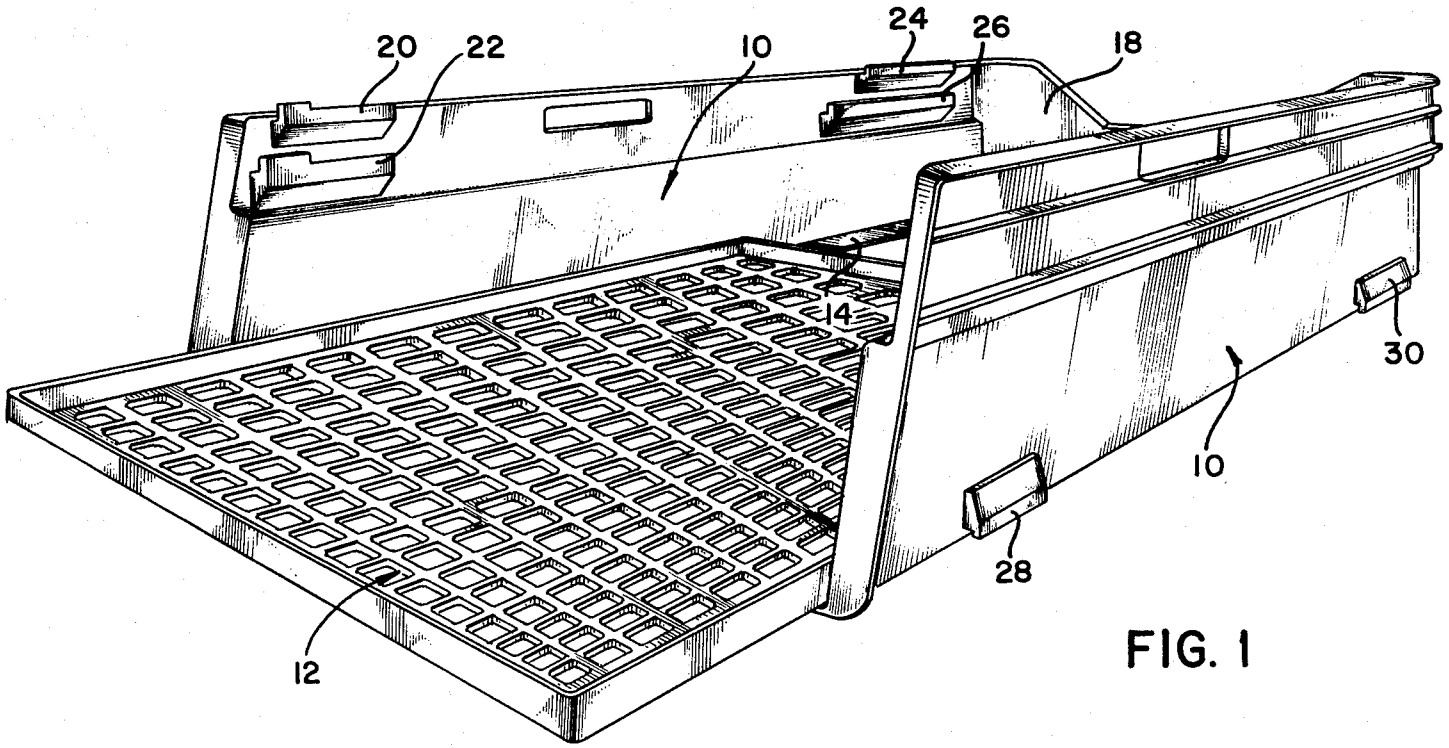
FIG. 1 is a perspective view of a nestable/stackable basket/tray combination representing one embodiment of the invention.

The container shown in FIG. 1 includes a nestable/-stackable basket 10, and a tray 12. Basket 10 has an open front end, and tray 12 is received through the open front end. This tray is slidably supported on flanges formed by the bentover lower edges, such as lower edge 14, of the sides of basket 10. The basket 10 has an open bottom, and the products container in the container are supported by tray 12. The tray 12 may be pulled out of the basket through the open front, and pushed back into the basket until it contacts the rear end 18 of the basket. The basket 10 and tray 12 may each be molded as single internal units and formed, for example, of an appropriate plastic material such as polypropylene by injection molding techniques.

Each side of basket 10 is provided with four stacking lugs, such as lugs 20, 22, 24 and 26. The forward portion of each of the stacking lugs adjacent to the open front of the basket has increased height, as shown, to define a shoulder with the rear portion thereof. Likewise, each side of the basket 10 is equipped with two lower stacking feet, such as foot 28 and foot 30.

The basket/tray container of FIG. 1 may be stacked on other like containers at a variety of stacking levels, as mentioned above. For example, in the top position, the feet 28 and 30 are supported by the upper lugs 20 and 24. To lower the basket down to the next position, the front end of the basket is lifted, so that feet 28 may be pulled clear of the forward end of lugs 20. The upper basket is then pulled forwardly until feet 30 drop down from the upper lugs 24 to the lower lugs 26. The upper basket may then be pushed back until the feet 28 are supported on the rear end of lugs 22. In each instance the lower stacking feet are retained on the stacking lugs by the shoulders described above.

Then, to nest an upper basket 10 in a lower basket, the upper basket is then again pulled up to lift the feet 28 off the lugs 22, and is pulled forward until the rear end of the basket drops to the top of the tray of the lower basket. The upper basket is then moved back so that it occupies its nesting position.

Figure 2:
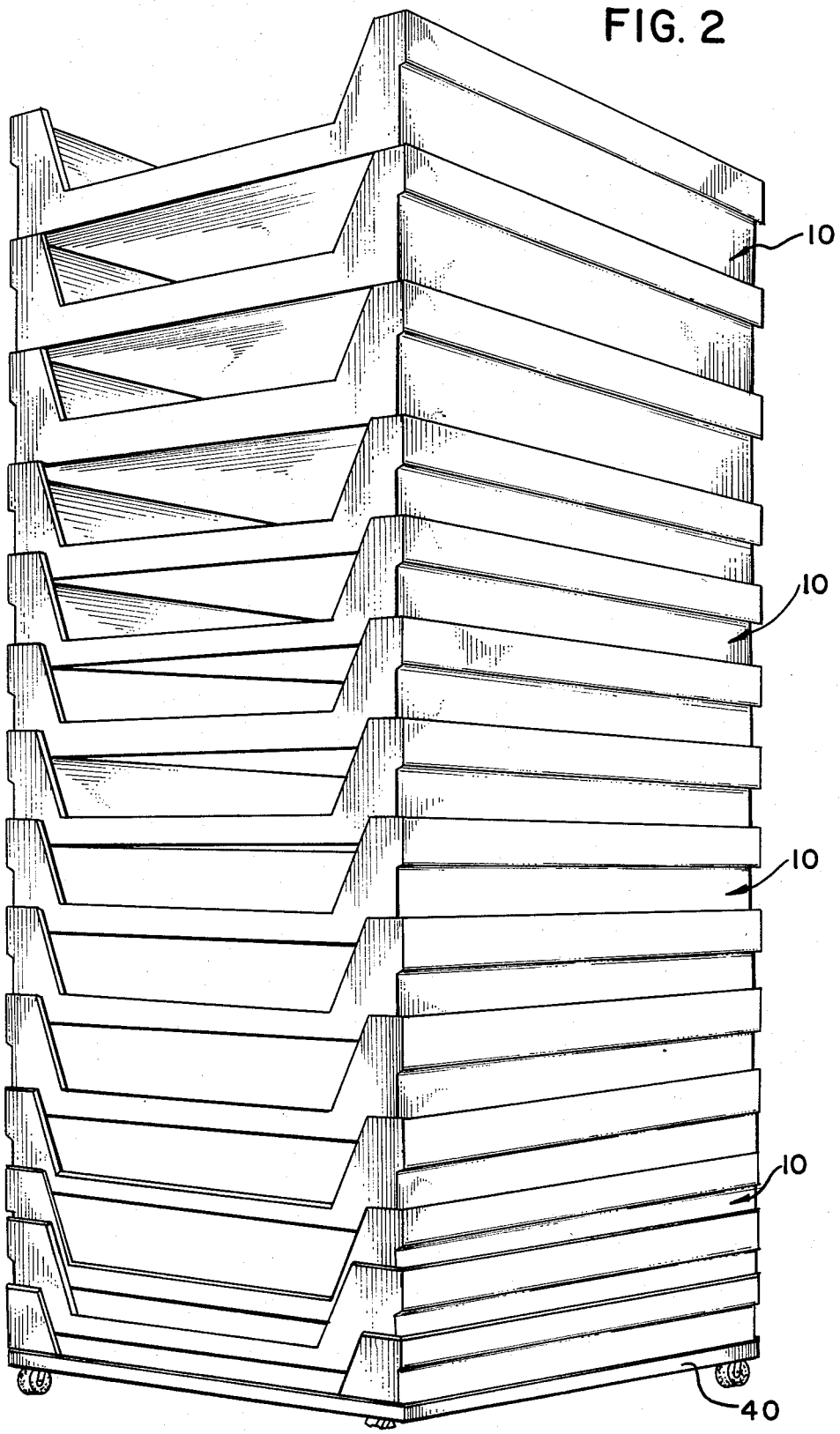
FIG. 2 is a perspective representation of a plurality of the basket/tray containers of FIG. 1 stacked on top of one another at different stacking heights, in a stack supported on a dolly, so as to accommodate bakery products of different heights and viewed from the back (closed end)

The stack shown in FIG. 2 shows 14 of the basket/-tray containers of FIG. 1 stacked at three positions, with the upper three containers being stacked at the top position, and the next eight containers being stacked at the intermediate position. Then, the next two containers are stacked in their nested position, with the lowermost containers again being stacked at the intermediate position. It is possible to combine any number of containers into any combination of stacking heights by manipulating them into the desired stacking heights as they are stacked. The basket/tray containers in the stack of FIG. 2 are supported on a wheeled dolly 40.

Acccordingly, the basket/tray containers in the stack of FIG. 1 may be loaded with different heights of bakery products at the bakery, and then wheeled to a loading dock. At the loading dock, the loaded stacks may be wheeled onto transport trucks to be transported to the depots at outlying areas, or else they may be loaded on a route truck, such as the route truck 50 shown in FIG. 3. The stacks may be transported by the route truck to the individual retail markets. At the markets the entire stacks may be removed and wheeled into the markets for the ultimate display of the products at the actual points of purchase.

Alternately, the trays 12 may be removed from the stacks, especially in cases where a particular market does not require all the products of a particular stack, and the individual trays may be carried into the markets, or orders may be selected by making up a stack of empties and sliding in tray of the required products. The tray 12 also are advantageous in that they permit the driver of the route truck to ascertain the various products in the individual baskets of the stacks merely by pulling out the corresponding tray.

Figure 4:
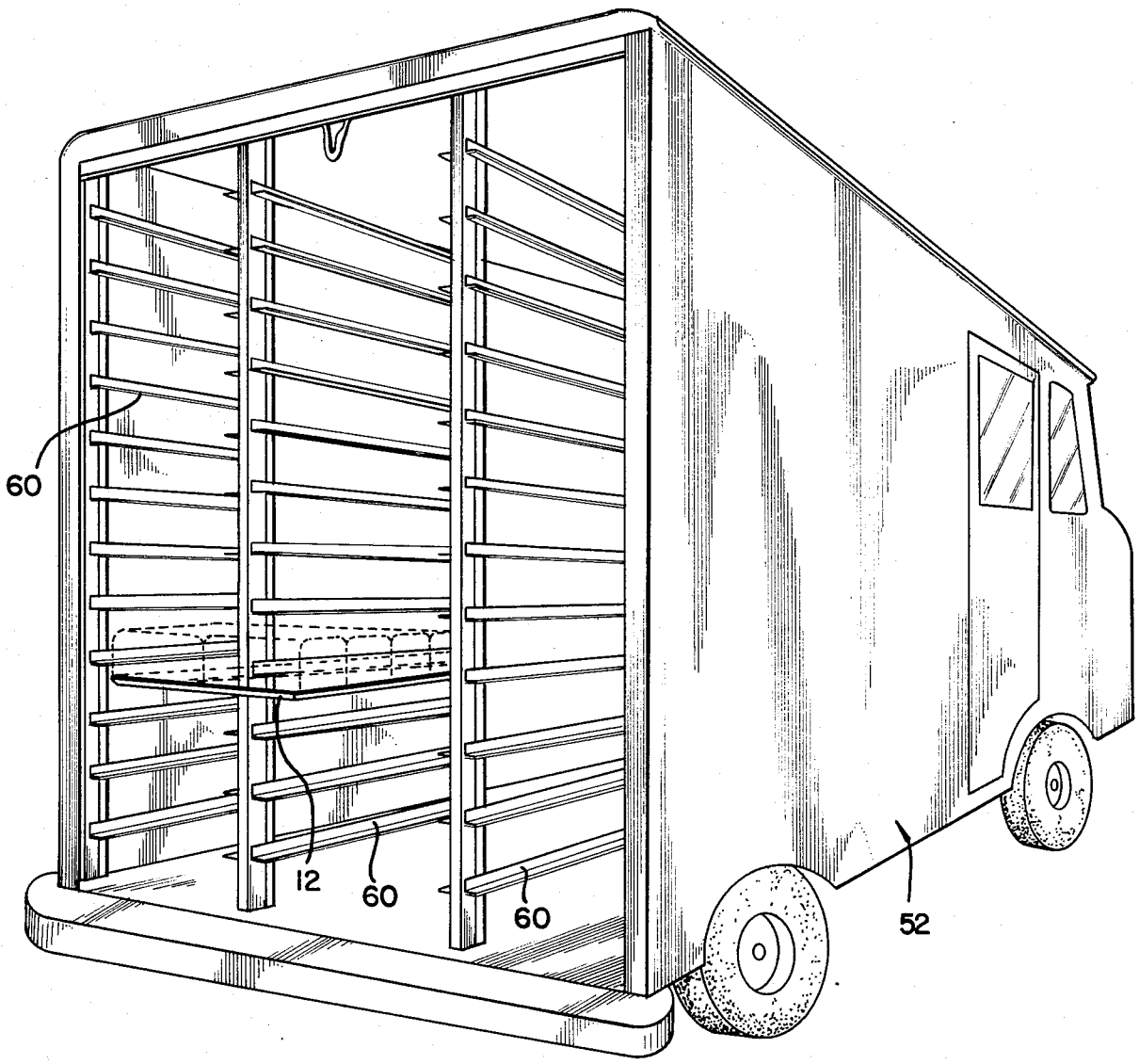
FIG. 4 is a perspective representation of a different type of route truck which is equipped with rails onto which the individual trays of the nestable/stackable basket/tray containers may be loaded by sliding the trays onto the rails.

The stacks of FIG. 2 may also be wheeled to the loading dock of the bakery, and the individual trays from the stacks may be removed and loaded into a route truck 52 shown in FIG. 4. The route truck 52 is equipped with rails 60, and the trays slide onto the rails as they are loaded in the route truck 52. When the route truck arrives at the various retail markets, the trays may be selectively removed so that the different products may be carried into the different markets.

Figure 3:
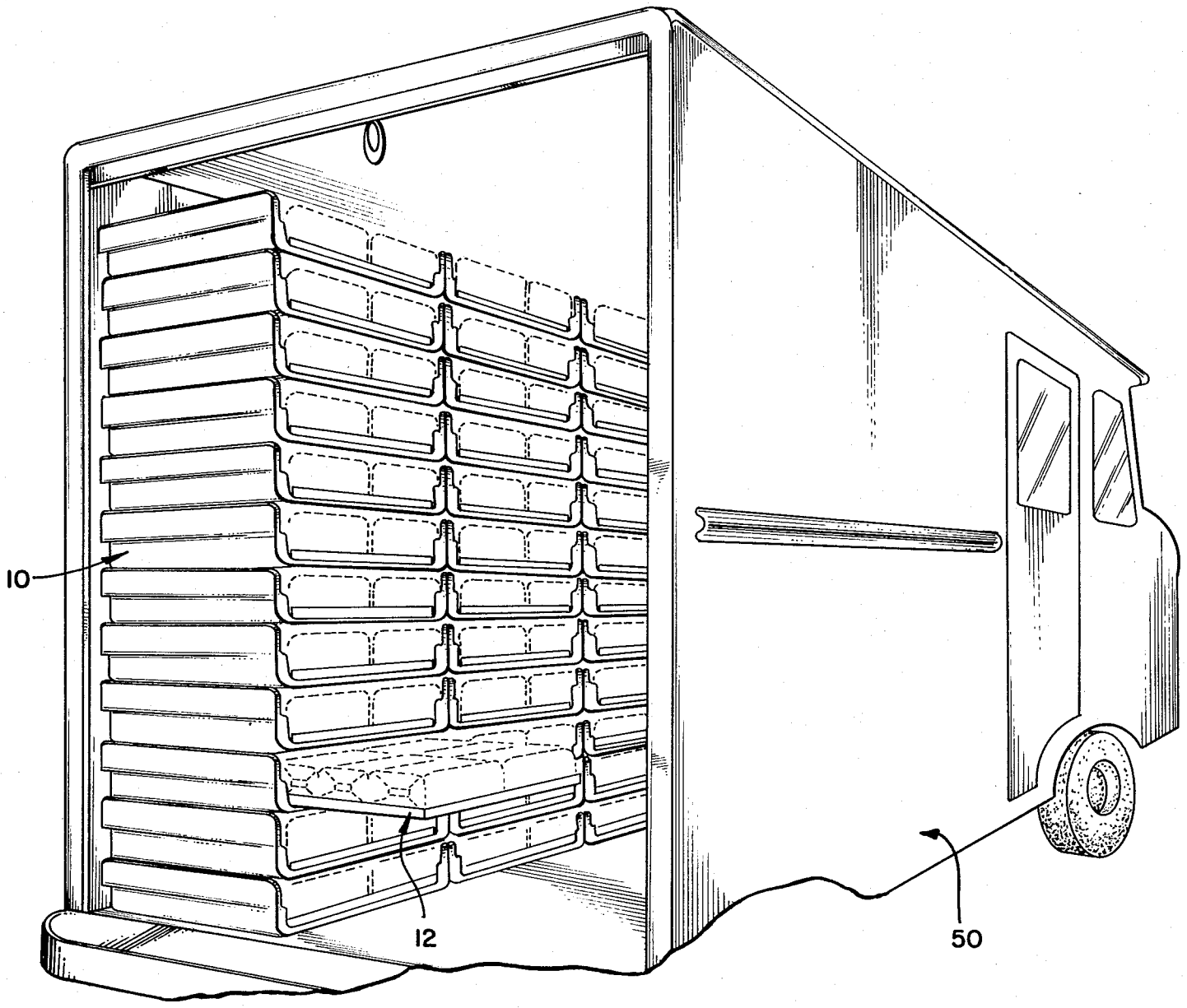
FIG. 3 is a perspective view of a typical route truck which is adapted to transport stacks of the nestable/-stackable basket/tray containers of FIG. 1 in appropriate stacks.
Figure 5:
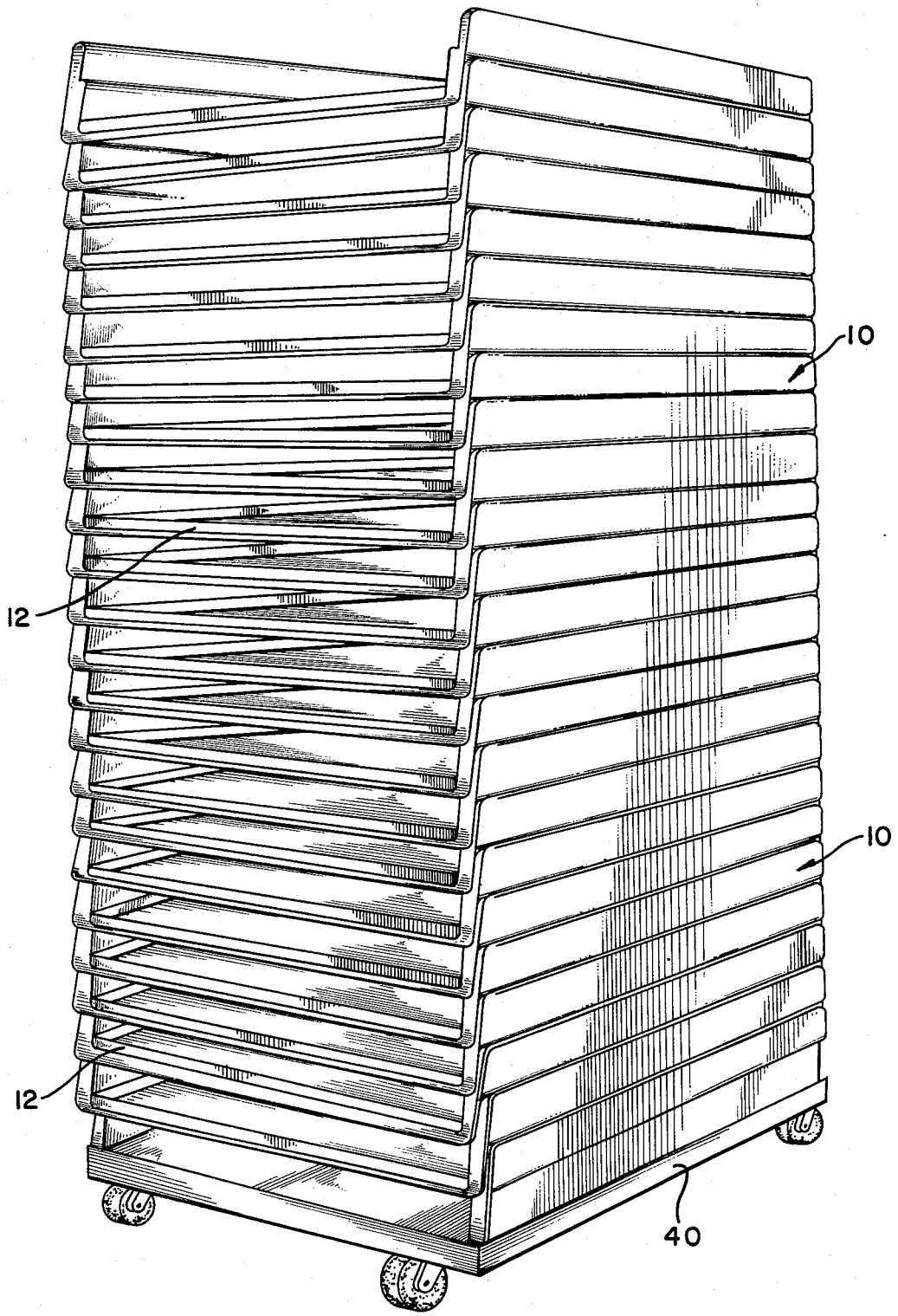
FIG. 5 is a perspective view of a stack of the nestable/stackable basket/tray containers of FIG. 1, in a nested position, when empty, for return to the bakery.

When the basket/tray containers transported by the transport trucks to the depots, or by the route trucks 50 or FIG. 3 to the individual markets, are empty, they may all be stacked in a nested condition on dollies, such as dolly 40 of FIG. 5 as a compact stack, so as to be returned to the bakery with an efficient utilization of the available space in the route trucks and in the transport trucks.

Figure 6:
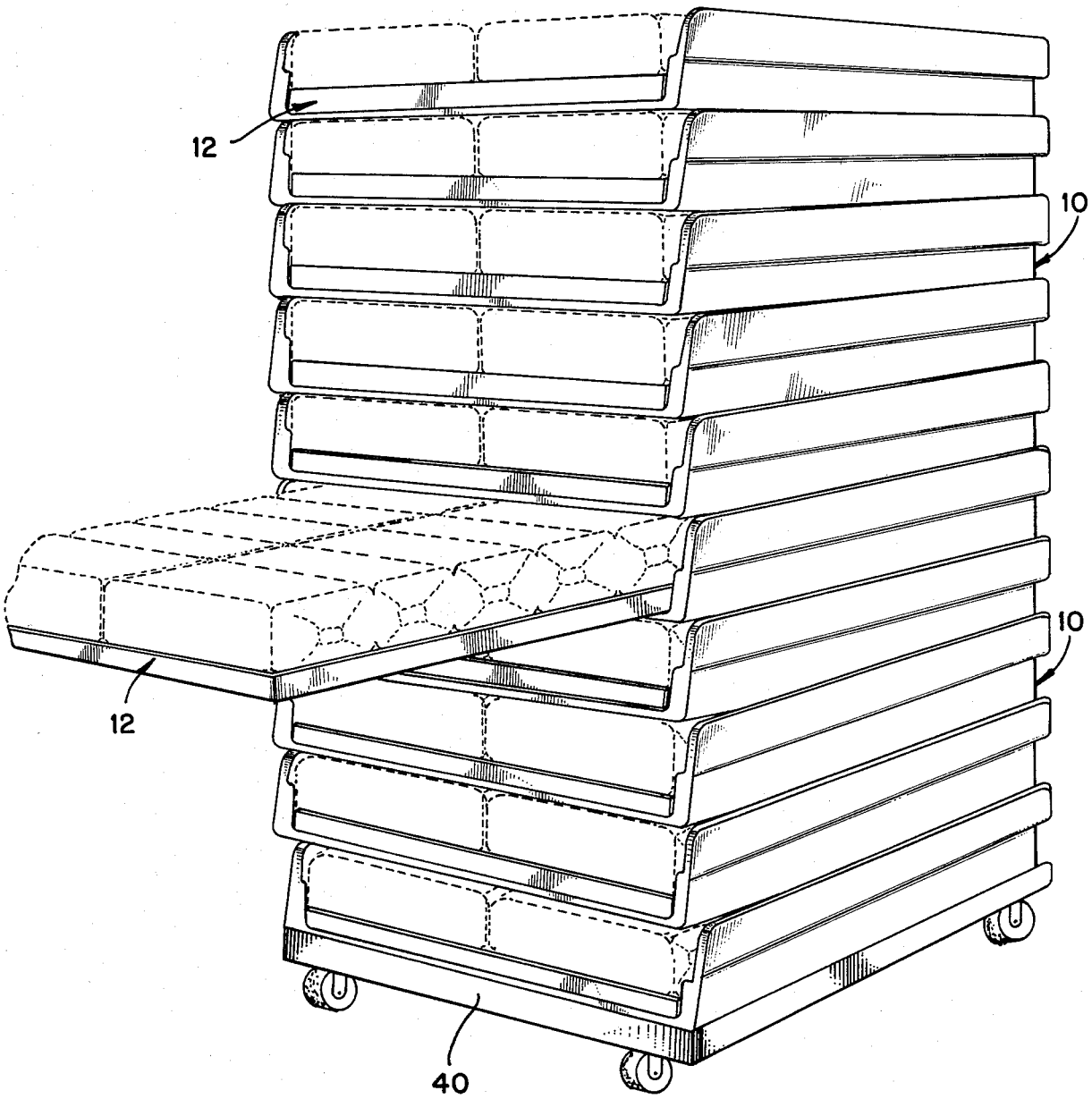
FIG. 6 is a perspective representation of a stack of the nestable/stackable basket/tray containers of FIG. 1, illustrating the manner in which each individual tray may be pulled out from its corresponding basket for a quick check of the contents of each container by the receiving store personnel.

When the bakery goods are delivered to the retail markets as stacks of the basket/tray containers, as shown in FIG. 3, the stacks may be loaded on dollies 40, as shown in FIG. 6, and they may be wheeled from the route trucks into the market, and positioned at appropriate locations in the market for selection and sale of the merchandise. The provision of the trays 12 permits each tray to be pulled out by the store personnel, without any need to disturb the stack, so as to assure that the proper merchandise is contained in each of the basket/tray combinations.

Figure 7:
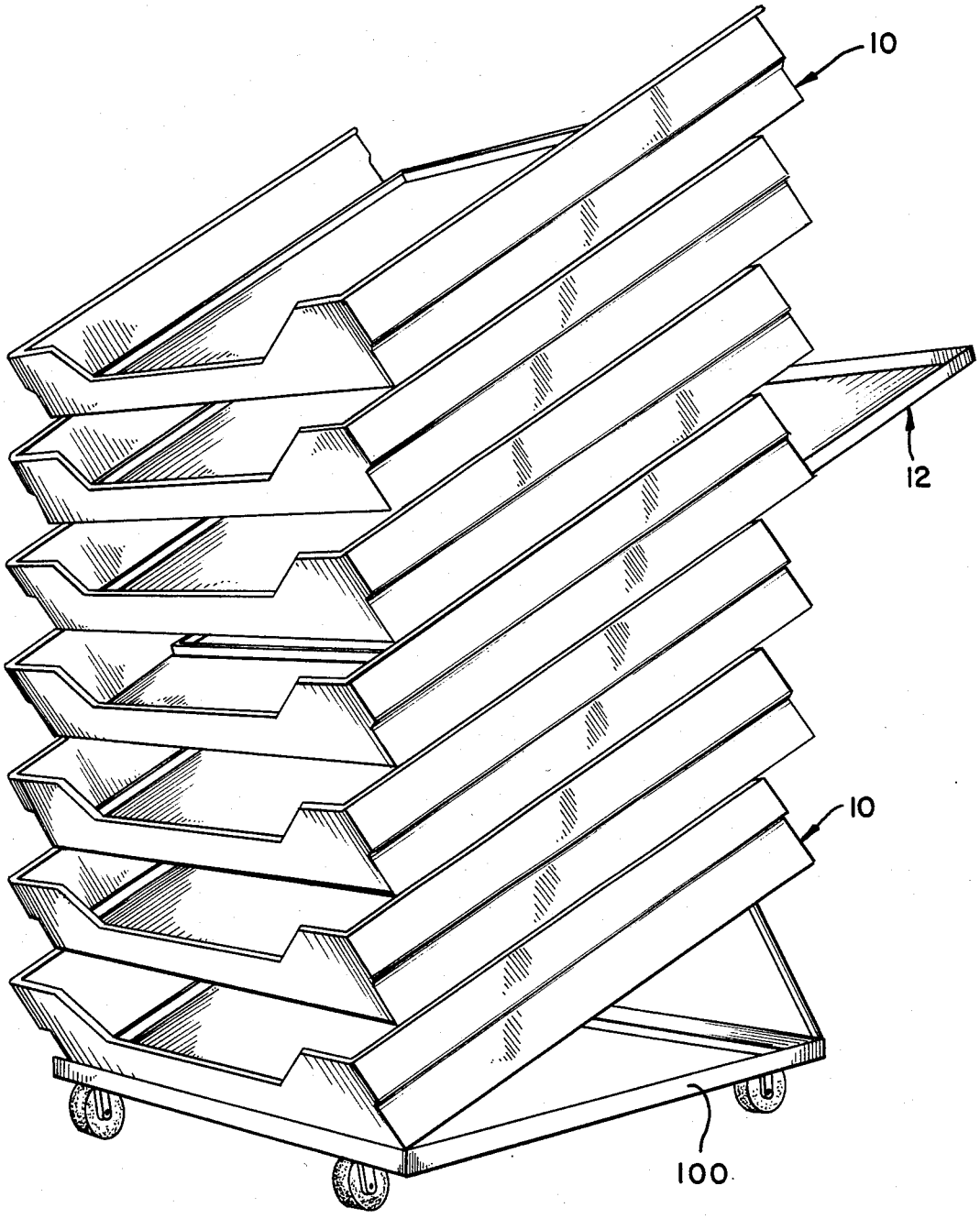
FIG. 7 is a perspective view of the nestable/stackable basket/tray containers of FIG. 1, illustrating the manner in which the containers may be loaded on a dolly in the retail market for a gravity feed display of the merchandise.

Moreover, the basket/tray containers delivered to the retail markets may be supported on dollies such as the dolly 100 of FIG. 7. The basket/tray containers are supported by dolly 100 in an inclined position, so that the merchandise is fed by gravity to the lower end of each basket for convenient selection by the purchaser. As any particular basket/tray container becomes empty, it may be replenished without any need to unstack the containers, and merely by pulling out the corresponding tray 12.

Figure 8:
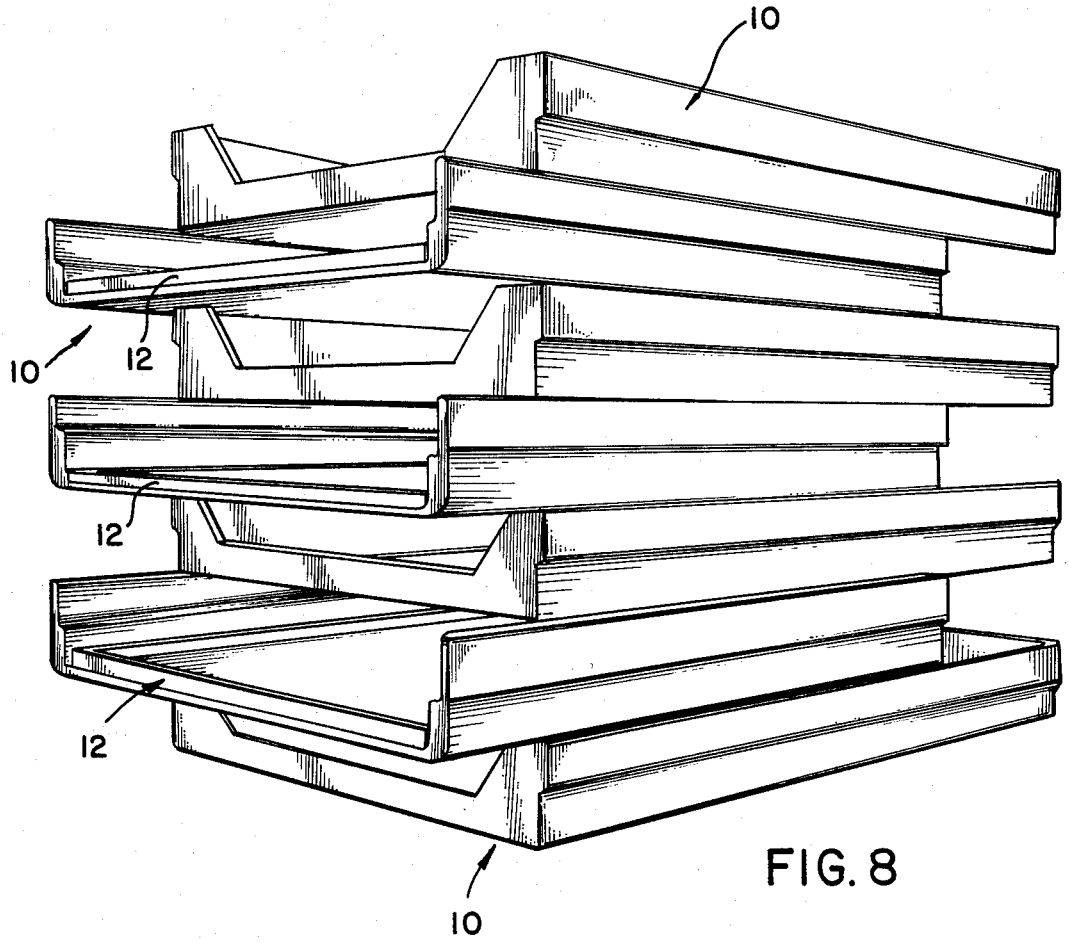
FIG. 8 is a perspective view of the nestable/stackable basket/tray containers of FIG. 1 in a zigzag display in the market for convenient selection of the products, in each of the stacks of FIGS. 7 and 8 the trays may be pulled out to replenish the stacks, without any need to unstack the individual basket/tray containers.

Also, and as shown in FIG. 8, the various basket/tray containers may be stacked in the market in a zigzag display, as shown in FIG. 8, for the convenient selection of the products by the purchaser.

The invention provides, therefore, an improved nestable/stackable basket/tray container which is intended to be used in a bakery distribution system, which has all the advantages of the various prior art distribution systems, but none of the disadvantages.

Specifically, the nestable/stackable basket/tray combination of the present invention have the following advantages over the prior art systems:

(a) the trays can slide out for access to the products while in the route trucks, such as shown in FIG. 3;

(b) the driver then has the option of putting trays into a rack for delivery to the store aisle, or he can load the basket/tray combinations on dollies and wheel them directly into the retail market;

(c) when in the market, he can then slide out the individual trays to permit the store personnel to check the shipment, rather than having to unstack the baskets;

(d) placing the merchandise on shelves is made much easier than the prior art systems; and (e) he can nest the empty baskets with the trays in place, for return to the bakery, and no further handling is necessary.

It will be appreciated that while a particular embodiment of the invention has been shown and described, modifications may be made. It is intended in the claims to cover all such modifications which come within the true spirit and scope of the invention.

What is claimed is:

1. A container comprising a basket formed of molded plastic material and constructed to be stacked on like baskets to form a rack, said basket having a rear wall and first and second side walls integral with one another and with said rear wall, and said basket further having an open bottom and an open front; inwardly extending flanges integral with said side walls and extending along the bottom edges thereof; and a tray slidably supported on said flanges to form a bottom for said basket, said tray being adapted to be pulled out through the open front of the basket.

2. The container defined in claim 1, in which said basket is constructed to be stacked on like baskets at a plurality of different stacking levels.

3. The container defined in claim 1, in which said tray is also formed of molded plastic material.

4. The container defined in claim 1, in which each of said side walls has a plurality of discrete integral upper stacking lugs formed on the inner surface thereof at spaced positions along the upper edge thereof, and each of said side walls has a plurality of discrete integral lower stacking feet formed on the outer surface thereof at spaced positions along the lower edge thereof, the lower stacking feet being positioned to be received on the upper stacking lugs of a like basket, and in which each of said side walls has a plurality of further integral stacking lugs formed on the inner surface thereof under respective ones of said upper stacking lugs; each of said further stacking lugs extending beyond the front end of the corresponding upper stacking lugs by a predetermined amount.

5. The container defined in claim 4, in which each of the upper stacking lugs adjacent to the open end of the basket has a forward portion of increased height defining a shoulder with the rear portion thereof for retaining the corresponding lower stacking feet of a like basket on the upper stacking lugs.

* * * * *